United States Patent [19]

Mayes

[11] Patent Number: 4,750,435

[45] Date of Patent: Jun. 14, 1988

[54] SYSTEM FOR DETECTING SLAG LEVEL IN A SOLID FUELS GASIFICATION REACTOR

[75] Inventor: Melvin D. Mayes, Baton Rouge, La.

[73] Assignee: The Dow Chemical Company, Midland, Mich.

[21] Appl. No.: 109,143

[22] Filed: Oct. 16, 1987

[51] Int. Cl.[4] ..... F23N 5/00

[52] U.S. Cl. ..... 110/192; 48/77; 48/056.2; 110/165 R; 110/230

[58] Field of Search ..... 110/185, 191, 192, 229, 110/230, 165 R, 169, 171, 259, 266; 48/77, DIG. 2, DIG. 10; 236/15 BR, 15 BE; 414/209, 216, 217, 221

[56] References Cited

U.S. PATENT DOCUMENTS 3,855,950 12/1974 Hughes, Jr. et al. ..... 110/165 R X
4,463,686 8/1984 Premel ..... 110/229 X
4,472,171 9/1984 Broderick ..... 110/165 R X
4,498,909 2/1985 Milner et al. ..... 110/229 X
4,520,737 6/1985 Van Kessel ..... 110/169 X

*Primary Examiner*—Steven E. Warner
*Attorney, Agent, or Firm*—V. Dean Clausen

[57] ABSTRACT

The invention is a system for detecting the level of slag in a solid fuels gasification reactor. In this invention a pokerod is extended into the quench chamber of the reactor, and pulled back to a retract position, in a timed sequence. The timed sequence is initiated by an electronic controller unit, in combination with an air pressure regulator, a solenoid valve, a double chamber air cylinder, and two sensor switches. The end of the pokerod that moves into the quench chamber is designed to contact the solid slag without penetrating the material itself. If the pokerod makes contact with the slag material, the controller sets off an alarm to warn the operator of slag build up in the reactor.

6 Claims, 2 Drawing Sheets

SYSTEM FOR DETECTING SLAG LEVEL IN A SOLID FUELS GASIFICATION REACTOR

BACKGROUND OF THE INVENTION

The invention relates to gasification of solid carbonaceous fuels such as coke, coal, or lignite. More specifically, the invention relates to a system for detecting the level of slag that can accumulate in the quench section of a solid fuels gasification reactor.

Solid fuels, such as coal, coke, or lignite can be used to make a useful synthetic gas product. In a typical process for gasifying coal, the solid lumps are ground into fine particles, mixed with oil or water, and fed into a gasification reactor. During the gasification process a substantial amount of molten slag forms in the hearth section of the reactor. The fluid slag then flows out of the hearth section through a taphole and down through a diptube into a quench chamber below the hearth. From the quench chamber, the slag drops down into a crusher unit that breaks it up and discharges it from the bottom of the reactor in a slurry form.

It is desirable to keep the temperature in the hearth as low as possible, to increase the life of the refractory lining and to improve gasification efficiency. The minimum operating temperature is usually determined by the melt temperature of the slag, since the slag has to flow through the taphole. But, if the reactor is running too close to the slag fluid temperature, the slag often forms long clinkers as it flows out of the taphole into the quench chamber. These clinkers tend to "bridge over" the inlet to the crusher unit, so that eventually the quench chamber and diptube fill up and the taphole is plugged off.

When the taphole becomes plugged, the reactor has to be shut down and the slag clinkers removed, which is a time-consuming procedure. Although there are "on-line" procedures for clearing the slag bridges in the quench chamber, such procedures are not entirely satisfactory. For example, the measures presently in use are detrimental to product gas quality, they're too costly, and they can damage the refractory lining in the taphole. Another major drawback is that the reactor operator has no clear indication of when the removal procedure needs to be initiated, because the slag build up forms under the surface of the water in the quench chamber. Inside this chamber the water is black, very hot and turbulent, and the pressure can be as high as 500 psi.

SUMMARY OF THE INVENTION

The invention is a system for detecting the level of a slag product in the quench section of a solid fuels gasification reactor. The system includes a housing member positioned adjacent to the quench chamber, and there is a fluid inlet port and a seal section in the housing. Fastened inside the housing member is a nozzle member having an open end that extends into the quench chamber. An elongate rod that provides a pokerod is carried inside the housing member, seal section, and nozzle member. The pokerod has one end coupled to an actuator means and the other end is a free end.

The actuator means is designed to move the pokerod to an extend position and then to a retract position. In the extend position the free end can contact any slag that has accumulated in the quench chamber. In the retract position the free end closes off the open end of the nozzle member. The actuator means is connected into an electronic controller unit adapted for timing an operation cycle. Two position sensors are located adjacent to the housing member, and each sensor is connected into the controller unit. Between the housing member and pokerod and between the nozzle and pokerod is an annular space that communicates with the fluid inlet port. A conduit connects this port into a source of fluid and a control valve in the conduit is connected into the electronic controller unit.

In a typical operation of this system, a signal from the controller causes the actuator means to move the pokerod to its extend position and to open the control valve, so that fluid is directed into the space surrounding the pokerod. When the pokerod reaches its extend position, as sensed by one of the position sensors, the controller unit closes the fluid control valve and causes the actuator means to move the pokerod to its retract position. When the pokerod reaches its retract position, as sensed by one of the position sensors, the controller unit returns to a dwell cycle.

DESCRIPTION OF THE INVENTION

Figure 1:
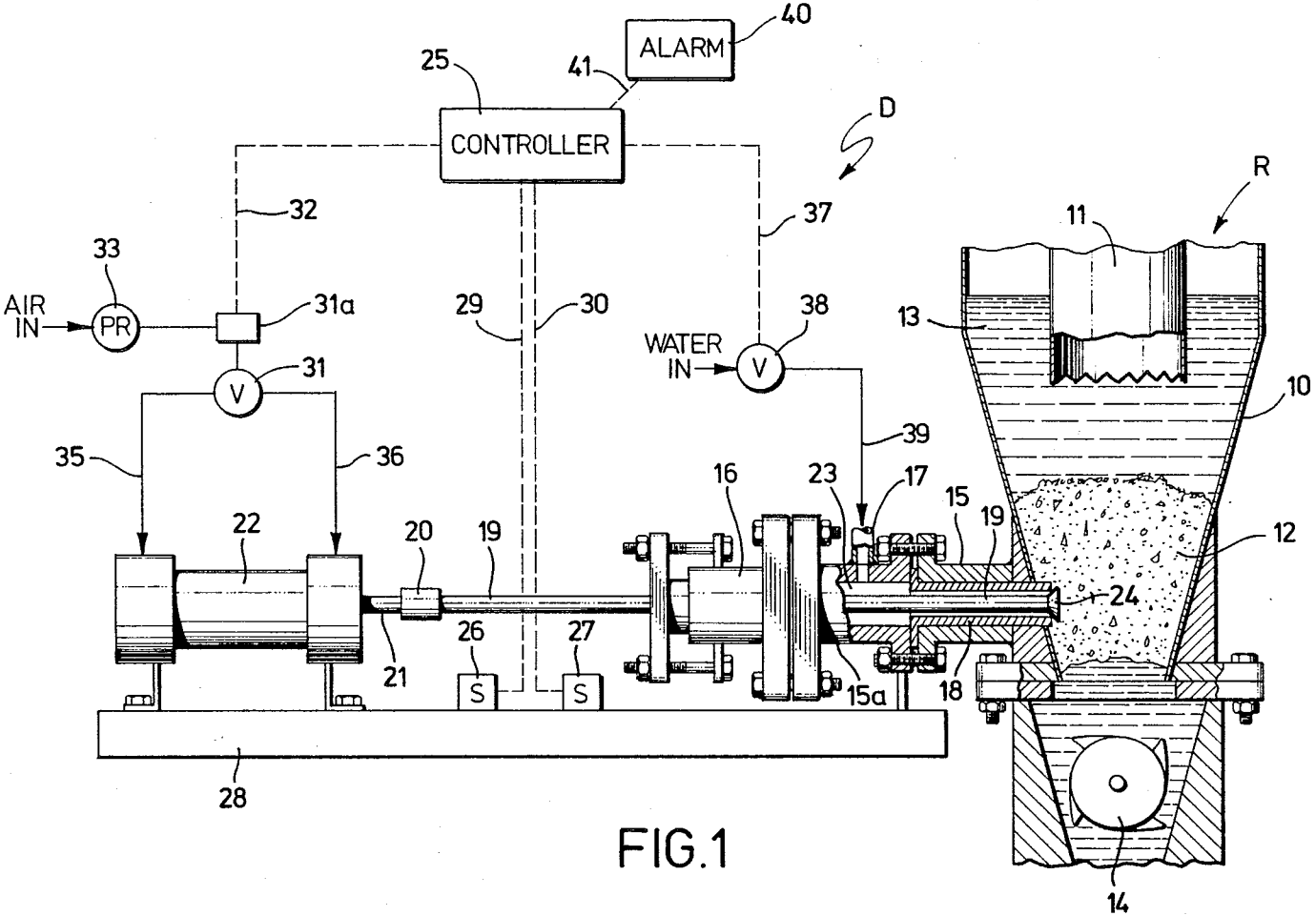
FIG. 1 is an elevation view, mostly in schematic, which illustrates the slag level detector system of this invention. In this figure the pokerod component of the detector system is shown in its retract position.

In the drawing, referring particularly to FIG. 1, part of a reactor for gasifying coal is shown, as indicated generally by the letter R. The reactor includes a quench chamber 10 with a diptube 11 extending down into the chamber. Above the quench chamber is a hearth section having a taphole therein that opens into the diptube (the hearth section and taphole are not shown). During the gasification process, molten slag 12 forms in the hearth section and drains down through the taphole and diptube into a water bath in the quench section. When slag accumulates in the quench chamber it can be washed down into a crusher unit 14, positioned below the open bottom end of the chamber. As mentioned earlier, the crusher unit breaks up the slag and discharges it in a slurry form.

Means for detecting the level of slag in the quench chamber 10 is provided by a slag level detector system, indicated generally by the letter D. The detector system includes a housing assembly consisting of a front section 15, a rear section 15*a*, and a stuffing box unit 16. The front section of the housing assembly is fastened to an outside wall of the quench chamber 10, and a fluid inlet port 17 is installed in the rear section. A nozzle member 18 fits inside the front section 15. The flange end of the nozzle is clamped between the front and rear sections of the housing assembly. The opposite end of the nozzle is open and it extends into the quench chamber.

Another component of the slag level detector is an elongate rod that defines a pokerod 19. In its operating position the pokerod is carried inside the housing assembly and the nozzle member 18. The stuffing box 16 is filled with packing material (not shown) that provides a fluid-tight seal around the pokerod. A coupling 20 joins one end of pokerod 19 to the piston shaft 21 of an air cylinder 22. Cylinder 22 is a conventional double-acting air cylinder, with a piston head inside the cylinder that divides the cylinder into two chambers (piston head and chambers are not shown).

Inside the housing assembly an annular space 23 is defined between the pokerod and the rear section 15*a* of the housing assembly, and between the pokerod and nozzle member 18. At the open end of nozzle 18 is the free end of the pokerod. A solid plate 24, that has a cone frustum shape with a flat base, is joined to the end of the pokerod. The flat surface of the base of plate 24 enables the plate to come into contact with the slag pile 12 without penetrating into the material itself. Also, the cone frustum shape allows the plate to close off the open end of nozzle 18 when the pokerod returns to its retract position. Another component of this system is an electronic controller unit 25, which is designed for timing an operation cycle. Limit switches 26 and 27 are mounted on a support member 28 behind the housing assembly and adjacent to the pokerod 19. These switches are connected into controller unit 25 by electrical leads 29 and 30, and they provide a means for sensing the location of the pokerod when the rod is at its extend position and retract position (explained in more detail later in this description).

This system also includes a solenoid valve 31, which has four ports (not shown). The solenoid 31*a* is connected by electrical lead 32 into controller 25, and a pressure regulator 33 is connected by air line 34 into the valve. One of the ports in valve 31 is connected by an air line 35 into a rear chamber (not shown) of air cylinder 22. Another port in the valve is connected by an air line 36 into the front chamber (not shown) of the air cylinder. Controller 25 is also connected by electrical lead 37 into solenoid valve 38, and a fluid line 39 connects the valve into the inlet port 17. Another component of the detector system is an alarm indicator 40, which is connected into the controller 25 by an electrical lead 41.

Operation

Figure 2:
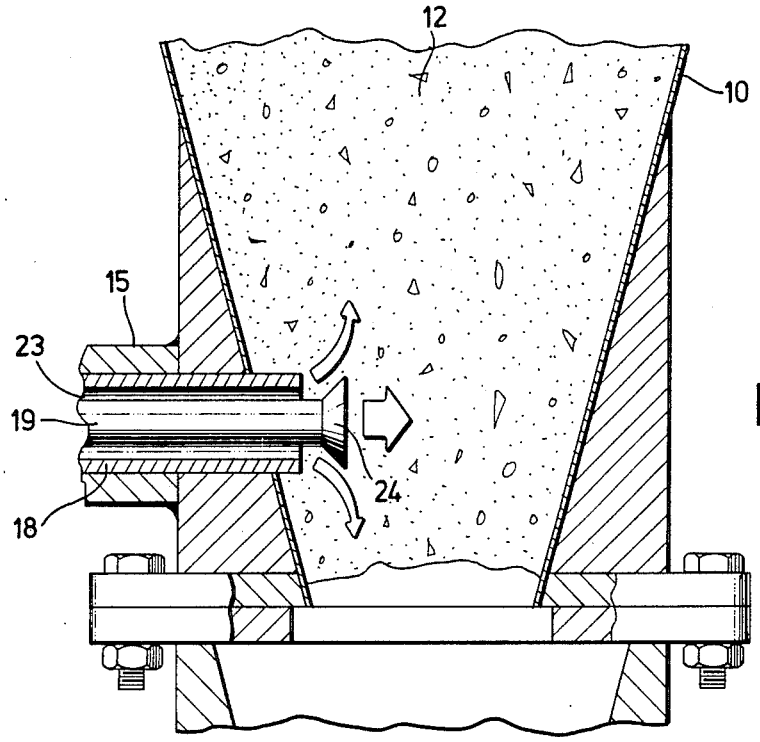
FIG. 2 is a detail view, mostly in schematic, which illustrates the pokerod component as it appears in its extend position.

The invention can be illustrated by describing a typical operation in which the detector system of this invention is used to detect a slag build up in the quench chamber of the reactor. At the start of this operation a timer switch (not shown) on controller 25 is set in the auto (automatic) position. The switch activates a timer device (not shown) in the controller to start a 15-minute "dwell" cycle. At the end of this cycle, the controller unit opens a port in solenoid valve 31 that is connected into air line 35. This allows air from regulator 33 to flow into the rear chamber of air cylinder 22, which starts the pokerod 19 moving toward its extend position, as shown in FIG. 2. At the same time, controller 25 opens fluid control valve 38 and starts a 5-second timer device (not shown) in the controller that is connected into limit switch 27.

The 5-second timer starts the pokerod 19 moving into the quench chamber 10 toward its extend position. During this movement the pokerod will go all the way to its extend position if the end plate 24 doesn't contact any slag particles, or other solid material. Opening valve 38 allows water to move through line 39 into the annular space 23 that surrounds pokerod 19. As the water flows into this space, it moves along the pokerod and out through the open end of nozzle 18 into the quench chamber 10, as indicated by the arrows in FIG. 2. Flushing the water through space 23 keeps the slag particles 12, and other solids, from interfering with the movement of pokerod 19. When the pokerod reaches the extend position, as sensed by the limit switch 26, the controller closes valve 38, to shut off water flow to the space 23 in the housing assembly. At the same time, the controller vents the port in valve 31 to air line 35, opens a port to air line 36, and actuates another 5-second timer.

With air line 36 open, air from regulator 33 flows into the front chamber of air cylinder 22 and starts the pokerod 19 moving back toward its retract position. During the 5-second cycle, the pokerod will move all the way back to its retract position, as sensed by limit switch 27. When the pokerod reaches the retract position, controller 25 signals valve 31 to close off the air flow to line 36, so that lines 36 and 35 are both closed. At the same time, the 15-minute timer is actuated and the controller returns to its dwell cycle.

In the sequence described above, the controller 25 moves the pokerod 19 through its extend and retract cycles and returns to the dwell cycle without interruption. But, if the slag material 12 starts to bridge over the inlet to crusher 14, and build up in the quench chamber 10, this system will detect the accumulated solids. For example, if the pokerod 19 is moving through its extend cycle, and the end plate 24 hits the solid material, the pokerod will stop moving. The uncompleted cycle is sensed by limit switch 26 and a signal is sent to controller 25 to set off alarm 40. When the reactor operator notices the alarm, he operates the timer switch manually to inactivate controller 25.

At this point the operator will check out the system for any mechanical or electrical malfunction that could cause a false activation of alarm 40. After correction of any problems, or determination that there are none, and the alarm seems to be working properly, the operator assumes there is a slag build up in the quench chamber. As a further check on proper operation of the system, the operator uses the timer switch manually in attempting to move the pokerod 19 into the quench chamber 10. If the pokerod can't be moved all the way to its extend position, the indication is that slag buildup is taking place in the quench chamber. The necessary procedures are then used to break up the slag accumulation and move it down into the crusher unit 14.

The invention claimed is:

1. In combination, a solid fuels gasification reactor and a system for detecting the level of a slag product in the reactor, the reactor includes a quench chamber having a discharge end that connects into a crusher unit, and the slag product is discharged from the quench chamber into the crusher unit, which reduces the particle size of the slag product, the slag level detector system comprises:

a housing assembly that includes a fluid inlet port and a seal section, the housing member is positioned adjacent to the quench chamber;

a nozzle member that fastens inside the housing assembly, and the nozzle member has an open end that extends into the quench chamber;

an elongate rod that defines a pokerod, the pokerod is carried inside the housing assembly and nozzle member, the pokerod has a coupled end and a free end, the coupled end is connected to an actuator means that moves the pokerod to an extend position in which the free end is adapted for contacting the slag product in the quench chamber, and to a retract position in which the free end is adapted for closing the open end of the nozzle member;

an electronic controller unit adapted for timing an operation cycle;

a first position sensor and second position sensor, each position sensor is located adjacent to the housing member, and each position sensor is connected into the electronic controller unit;

a space is defined between the pokerod and nozzle member, and between the pokerod and housing member, the fluid inlet port is in communication with this space;

a conduit connects the fluid inlet port into a source of fluid, a fluid control valve is installed in the conduit, and the control valve is connected into the electronic controller;

wherein, in operation, on signal from the electronic controller unit, the actuator means moves the pokerod toward its extend position, and the controller unit opens the fluid control valve to direct fluid into the space between the pokerod and housing member and the pokerod and nozzle member;

at the extend position of the pokerod, as sensed by the first position sensor, the electronic controller unit closes the fluid control valve and the actuator means moves the pokerod toward its retract position;

at the retract position of the pokerod, as sensed by the second position sensor, the electronic controller unit assumes a dwell sequence before resuming operation of the actuator means.

2. The slag level detector system of claim 1 in which the actuator means comprises:

an air cylinder having a piston therein that divides the cylinder into a first chamber and second chamber, a solenoid valve having several ports, and an air pressure regulator;

the pokerod is coupled to the piston, the solenoid valve is connected into the the electronic controller unit, the air pressure regulator is connected into one of the ports in the solenoid valve, and each air cylinder chamber is connected into one of the ports in the solenoid valve;

wherein, in operation, the electronic controller unit opens a first port in the solenoid valve, air from the pressure regulator passes through the first port into the first chamber of the air cylinder, the pokerod moves to its extend position in the quench chamber, the electronic controller unit vents the first port in the solenoid valve and opens a second port in the valve, air passes through the second port into the second chamber of the air cylinder, and the pokerod moves to its retract position.

3. The slag level detector system of claim 1 in which the first position sensor is a limit switch that senses the location of the pokerod when the pokerod is at its extend position.

4. The slag level detector system of claim 1 in which the second position sensor is a limit switch that senses the position of the pokerod when the pokerod is at its retract position.

5. The slag level detector system of claim 1 in which the free end of the pokerod is defined by a solid plate having a cone frustum shape, and including a base surface adapted for contacting the slag product in the quench chamber.

6. The slag level detector system of claim 1 in which the housing assembly is attached to the quench chamber.

* * * * *